US006914580B2

(12) United States Patent
Leisten

(10) Patent No.: US 6,914,580 B2
(45) Date of Patent: Jul. 5, 2005

(54) DIELECTRICALLY-LOADED ANTENNA

(75) Inventor: Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 30 days.

(21) Appl. No.: 10/457,717

(22) Filed: Jun. 9, 2003

(65) Prior Publication Data

US 2004/0189541 A1 Sep. 30, 2004

(30) Foreign Application Priority Data

Mar. 28, 2003 (GB) ..... 0307251

(51) Int. Cl.[7] ..... H01Q 1/36
(52) U.S. Cl. ..... 343/895; 343/741
(58) Field of Search ..... 343/702, 741, 343/742, 866, 895

(56) References Cited

U.S. PATENT DOCUMENTS

| | | | | |
|---|---|---|---|---|
| 4,008,479 A | * | 2/1977 | Smith | 343/895 |
| 4,114,164 A | | 9/1978 | Greiser | |
| 5,134,422 A | * | 7/1992 | Auriol | 343/895 |
| 5,198,831 A | | 3/1993 | Burrell et al. | |
| 5,346,300 A | * | 9/1994 | Yamamoto et al. | 343/895 |
| 5,854,608 A | * | 12/1998 | Leisten | 343/895 |
| 5,859,621 A | * | 1/1999 | Leisten | 343/895 |
| 5,945,963 A | | 8/1999 | Leisten | |
| 5,963,180 A | * | 10/1999 | Leisten | 343/895 |
| 6,088,000 A | | 7/2000 | Ho | |
| 6,184,845 B1 | | 2/2001 | Leisten et al. | |
| 6,300,917 B1 | | 10/2001 | Leisten et al. | |
| 2001/0045916 A1 | | 11/2001 | Noro et al. | |

FOREIGN PATENT DOCUMENTS

| | | |
|---|---|---|
| EP | 0649181 | 4/1995 |
| FR | 2746547 | 9/1997 |
| FR | 2814286 | 3/2002 |
| GB | 2321785 | 8/1995 |
| GB | 2292638 A | 2/1996 |
| GB | 2351850 | 1/2001 |
| JP | 2000036707 A | 2/2000 |
| WO | WO 99/60665 | 11/1999 |

OTHER PUBLICATIONS

Search Report Under Section 17(5), Patents Act of 1977, British Patent Office, issued in connection with Application No. GB 0307251.9 issued on Jul. 18, 2003.

* cited by examiner

*Primary Examiner*—Tho Phan
(74) *Attorney, Agent, or Firm*—John Bruckner PC

(57) ABSTRACT

A dielectrically-loaded loop antenna with a cylindrical dielectric core, a feeder structure passing axially through the core, a sleeve balun encircling one end portion of the core and helical antenna elements extending from a feed connection with the feeder structure at the other end of the core to the rim of the balun. The antenna elements are arranged as a pair of laterally opposed groups of conductive elongate helical elements each having at least first and second conductive elements of different electrical lengths to form a plurality of looped conductive paths. By forming at least one of the conductive elements in each group as a conductive strip with one or both edges meandered, such that the edges of the strip are non-parallel and have different electrical lengths, additional modes of resonance arc created, yielding an improvement in bandwidth.

23 Claims, 5 Drawing Sheets

DIELECTRICALLY-LOADED ANTENNA

CROSS-REFERENCE TO RELATED APPLICATION

This application is related to, and claims a benefit of priority under one or more of 35 U.S.C. 119(a)–119(d) from copending foreign patent application United Kingdom 0307251.9, filed Mar. 28, 2003, the entire contents of which are hereby expressly incorporated herein by reference for all purposes.

FIELD OF THE INVENTION

This invention relates to a dielectrically-loaded antenna for operation at frequencies in excess of 200 MHz, and in particular to a loop antenna having a plurality of resonant frequencies within a band of operation.

BACKGROUND OF THE INVENTION

A dielectrically-loaded loop antenna is disclosed in British Patent Application No. 2309592A. Whilst this antenna has advantageous properties in terms of isolation from the structure on which it is mounted, its radiation pattern, and specific absorption ratio (SAR) performance when used on, for instance, a mobile telephone close to the user's head, it suffers from the generic problem of small antennas in that it has insufficient bandwidth for many applications. Improved bandwidth can be achieved by splitting the radiating elements of the antenna into portions having different electrical lengths. For example, as disclosed in British Patent Application No. 2321785A, the individual helical radiating elements can each be replaced by a pair of mutually adjacent, substantially parallel, radiating elements connected at different positions to a linking conductor linking opposed radiating elements. In another variation, disclosed in British Patent Application No. 2351850A, the single helical elements are replaced by laterally opposed groups of elements, each group having a pair of coextensive mutually adjacent radiating elements in the form of parallel tracks having different widths to yield differing electrical lengths. These variations on the theme of a dielectrically-loaded twisted loop antenna gain advantages in terms of bandwidth by virtue of their different coupled modes of resonance which occur at different frequencies within a required band of operation.

It is an object of the invention to provide a further improvement in bandwidth.

SUMMARY OF THE INVENTION

According to this invention, there is provided a dielectrically-loaded loop antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of conductive elongate elements, each group comprising first and second substantially coextensive elongate elements which have different electrical lengths at a frequency within an operating frequency band of the antenna and are coupled together at respective first ends at a location in the region of the feed connection and at respective second ends at a location spaced from the feed connection, the antenna element structure further comprising a linking conductor linking the second ends of the first and second elongate elements of one group with the second ends of the first and second elements of the other group, whereby the first elements of the two groups form part of a first looped conductive path, and the second elements of the two groups form part of a second looped conductive path, such that the said paths have different respective resonant frequencies within the said band and each extend from the feed connection to the linking conductor, and then back to the feed connection, wherein at least one of the said elongate antenna elements comprises a conductive strip having non-parallel edges.

Looked at a different way, the invention provides an antenna in which at least one of the said elongate antenna elements comprises a conductive strip on the outer surface of the core, which strip has opposing edges of different lengths.

Preferably, the edge of the strip which is furthest from the other elongate element or elements in its group is longer than the edge which is nearer the other element or elements. Indeed, both the first and second elongate elements of each group may have edges of different lengths, e.g., in that each such element which has an edge forming an outermost edge of the group is configured such that the outermost edge is longer than the inner edge of the element.

Such differences in edge length may be obtained by forming each affected element so that one of its edges follows a wavy or meandered path along substantially the whole of its radiating length. Thus, in the case of the antenna being a twisted loop antenna, with each group of elements executing a half turn around the central axis of a cylindrical dielectric core, the helical portion of each element has one edge which follows a strict helical path, whilst the other edge follows a path which deviates from the strict helical path in a sinusoid, castellated or smooth pattern, for example.

Advantageously, where both outermost edges of each group of elements follow a path which varies from the strict helix, the variations are equal for both edges at any given position along the length of the group of elements so that the overall width of the group at any given position is substantially the same. Indeed, the outermost edges may be formed so as to be parallel along at least a major part of the length of the group of elements.

Such structures take advantage of the discovery by the applicant that grouped and substantially coextensive radiating elements of different electrical lengths have fundamental modes of resonance corresponding not only to the individual elements which are close together, but also corresponding to the elements as a combination. Accordingly, where each group of elements has two substantially coextensive mutually adjacent elongate radiating elements, there exists a fundamental mode of resonance associated with one of the tracks, another fundametal resonance associated with the other of the tracks, and a third fundamental resonance associated with the composite element represented by the two tracks together. The frequency of the third resonance can be manipulated by asymmetrically altering the lengths of edges of the elements. In particular, by lengthening the outer edges of the two elements of each group, the frequency of the third resonance can be altered differently, and to a greater degree, than the resonant frequencies associated with the individual tracks. It will be appreciated, therefore, that, the third frequency of resonance can be brought close to the other resonant frequencies so that all three couple together to form a wider band of reduced insertion loss than can be achieved with the above-described prior art antennas, at least for a given resonance type (i.e., in this case, the balanced modes of resonance in the preferred antenna).

An antenna as described above, having groups of laterally opposed elongate antenna elements with each group having two mutually adjacent such elements, is one preferred embodiment of the invention. In that case, the elongate elements of each pair have different electrical lengths and define between them a parallel sided channel, each element having a meandered outer edge.

In an alternative embodiment, each group of elongate antenna elements has three elongate elements, arranged side-by-side. In this case, each group comprises an inner element and two outer elements. Preferably, the outwardly directed edges of the two outer elements of each group are meandered or otherwise caused to deviate from a path parallel to the corresponding inner edges, and the inner element is parallel-sided. More preferably, at least one of the outer elements of each group has a deviating outer edge and a deviating inner edge, the amplitude of the outer edge deviation being greater than the amplitude of the inner edge deviation.

Using groups of two elements with non-parallel edges it is possible to achieve a fractional bandwidth in excess of 3% at an insertion loss of −6 dB. Embodiments with three or more elements per group offer further bandwidth gains, in terms of fractional bandwidth and/or insertion loss.

The antennas described above have particular application in the frequency division duplex portion of the IMT-2000 3-G receive and transmit bands (2110–2170 MHz and 1920–1980 MHz). They can also be applied to other mobile communication bands such as the GSM-1800 band (1710–1880 MHz), the PCS1900 band (1850–1990 MHz) and the Bluetooth LAN band (2401–2480 MHz).

The invention will be described below in more detail with reference to the drawings

DETAILED DESCRIPTION OF THE PREFERRED EMBODIMENTS

Figure 1:
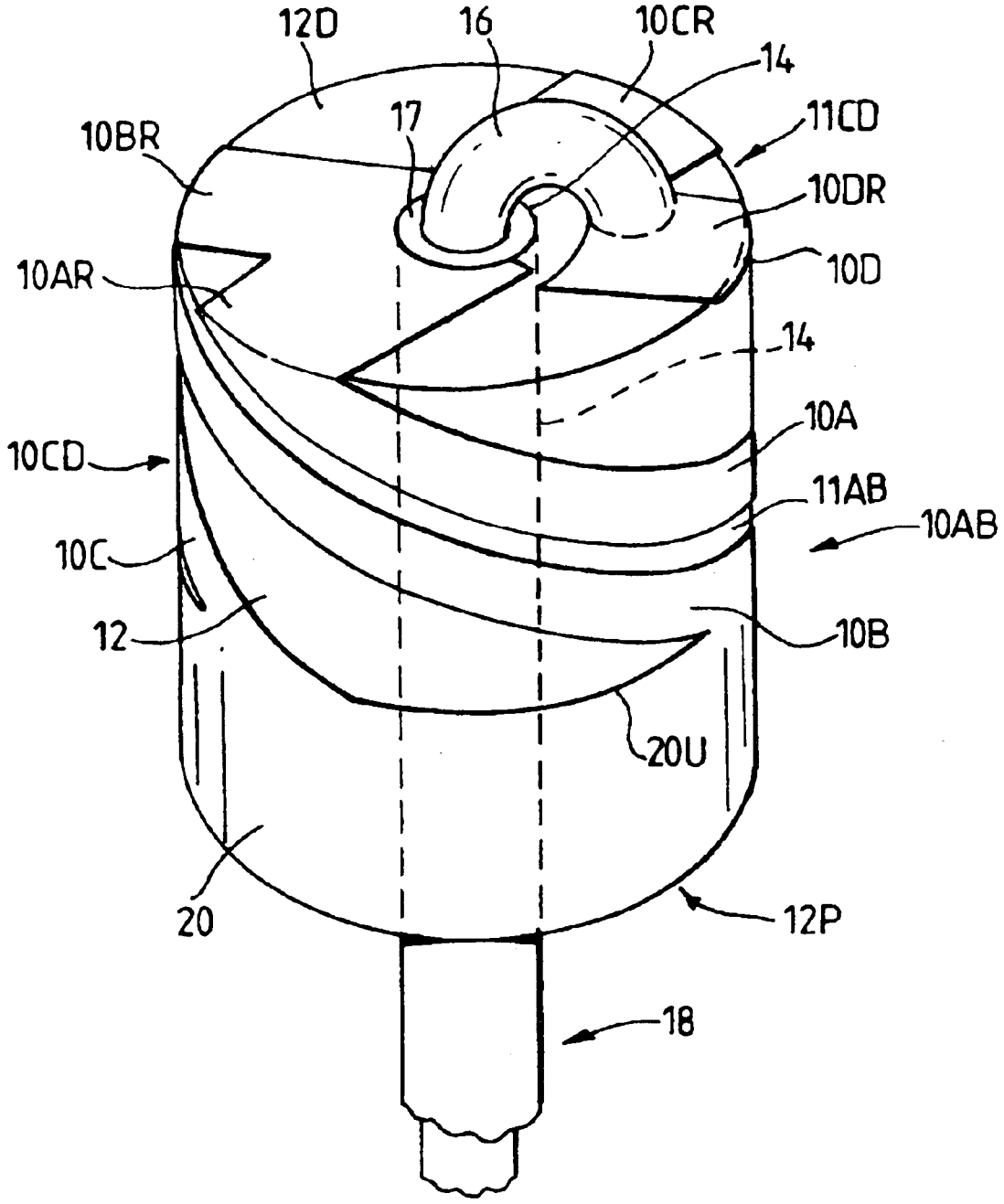
FIG. 1 is a perspective view of a dielectrically-loaded antenna having two laterally opposed groups of helical radiating elongate elements.

Referring to FIG. 1, an antenna of a construction similar to that shown in British Patent Application No. 2351850A has an antenna element structure comprising a pair of laterally opposed groups 10AB, 10CD of elongate radiating antenna elements 10AB, 10CD. The term "radiating" is used in this specification to describe antenna elements which, when the antenna is connected to a source of radio frequency energy, radiate energy into the space around the antenna. It will be understood that, in the context of an antenna for receiving radio frequency signals, the term "radiating elements" refers to elements which couple energy from the space surrounding the antenna to the conductors of the antenna for feeding to a receiver.

Each group of elements comprises, in this embodiment, two coextensive, mutually adjacent and generally parallel elongate antenna elements 10A, 10B, 10C, 10D which are disposed on the outer cylindrical surface of an antenna core 12 made of a ceramic dielectric material having an relative dielectric constant greater than 5, typically 36 or higher. The core 12 has an axial passage 14 with an inner metallic lining, the passage 14 housing an axial inner feeder conductor 16 surrounded by a dielectric insulating sheath 17. The inner conductor 16 and the lining together form a coaxial feeder structure which passes axially through the core 12 from a distal end face 12D of the core to emerge as a coaxial transmission line 18 from a proximal end face 12P of the core 12. The antenna element structure includes corresponding radial elements 10AR, 10BR, 10CR, 10DR formed as conductive tracks on the distal end face 12D connecting distal ends of the elements 10A to 10D to the feeder structure. The elongate radiating elements 10A to 10D, including their corresponding radial portions, are of approximately the same physical length, and each includes a helical conductive track executing a half turn around the axis of the core 12. Each group of elements comprises a first element 10A, 10C of one width and a second element 10B, 10D of a different width. These differences in width cause differences in electrical lengths, due to the differences in wave velocity along the elements.

To form complete conductive loops, each antenna element 10A to 10D is connected to the rim 20U of a common virtual ground conductor in the form of a conductive sleeve 20 surrounding a proximal end portion of the core 12 as a link conductor for the elements 10A to 10D. The sleeve 20 is, in turn, connected to the lining of the axial passage 14 by conductive plating on the proximal end face 12D of the core 12. Thus, a first 360 degrees conductive loop is formed by elements 10AR, 10A, rim 20U, and elements 10C and 10CR, and a second 360 degree conductive loop is formed by elements 10BR, 10B, the rim 20U, and elements 10D and 10DR. Each loop extends from one conductor of the feeder structure around the core to the other conductor of the feeder structure. The resonant frequency if one loop is slightly different from that of the other.

At any given transverse cross-section through the antenna, the first and second antenna elements of the first group 10AB are substantially diametrically opposed to the corresponding first and second elements, respectively, of the second group 10C. It will be noted that, owing to each helical portion representing a half turn around the axis of the core 12, the first ends of the helical portions of each conductive loop are approximately in the same plane as their second ends, the plane being a plane including the axis of the core 12. Additionally it should be noted that the circumferential spacing, i.e. the spacing around the core, between the neighbouring elements of each group is less than that between the groups. Thus, elements 10A and 10B are closer to each other than they are to the elements 10C, 10D.

The conductive sleeve 20 covers a proximal portion of the antenna core 12, surrounding the feeder structure 18, the material of the core filing substantially the whole of the space between the sleeve 20 and the metallic lining of the axial passage 14. The combination of the sleeve 20 and plating forms a balun so that signals in the transmission line formed by the feeder structure 18 are converted between an unbalanced state at the proximal end of the antenna and a balanced state at an axial position above the plane of the upper edge 20U of the sleeve 20. To achieve this effect, the axial length of the sleeve is such that, in the presence of an underlying core material of relatively high dielectric constant, the balun has an electrical length of about $\lambda/4$ or 90° in the operating frequency band of the antenna. Since the core material of the antenna has a foreshortening effect, the annular space surrounding the inner conductor is filled with an insulating dielectric material having a relatively small dielectric constant, the feeder structure 18 distally of the sleeve has a short electrical length. As a result, signals at the distal end of the feeder structure 18 are at least approximately balanced. A further effect of the sleeve 20 is that for frequencies in the region of the operating frequency of the antenna, the rim 20U of the sleeve 20 is effectively isolated from the ground represented by the outer conductor of the feeder structure. This means that currents circulating between the antenna elements 10A to 10D are confined substantially to the rim part. The sleeve thus acts as an isolating trap when the antenna is resonant in a balanced mode.

Since the first and second antenna elements of each group 10AB, 10CD are formed having different electrical lengths at a given frequency, the conductive loops formed by the elements also have different electrical lengths. As a result, the antenna resonates at two different resonant frequencies, the actual frequencies depending, in this case, on the widths of the elements. As FIG. 1 shows, the generally parallel elements of each group extend from the region of the feed connection on the distal end face of the core to the rim 20U of the balun sleeve 20, thus defining an inter-element channel 11AB, 11CD, or slit, between the elements of each group.

The length of the channels are arranged to achieve substantial isolation of the conductive paths from one another at their respective resonant frequencies. This is achieved by forming the channels with an electrical length of $\lambda/2$, or $n\lambda/2$ where n is an odd integer. In effect, therefore, the electrical lengths of each of those edges of the conductors 10A to 10D bounding the channels 11AB, 11CD are also $\lambda/2$ or $n\lambda/2$. At a resonant frequency of one of the conductive loops, a standing wave is set up over the entire length of the resonant loop, with equal values of voltage being present at locations adjacent the ends of each $\lambda/2$ channel, i.e. in the regions of the ends of the antenna elements. When one of the loops is resonating, the antenna elements which form part of the non-resonating loop are isolated from the adjacent resonating elements, since equal voltages at either ends of the non-resonant elements result in zero current flow. When the other conductive path is resonant, the other loop is likewise isolated from the resonating loop. To summarise, at the resonant frequency of one of the conductive paths, excitation occurs in that path simultaneously with isolation from the other path. It follows that at least two quite distinct resonances are achieved at different frequencies due to the fact that each branch loads the conductive path of the other only minimally when the other is at resonance. In effect, two or more mutually isolated low impedance paths are formed around the core.

The channels 11AB, 11CD are located in the main between the antenna elements 10A, 10B and 10C, 10D respectively, and by a relatively small distance into the sleeve 20. Typically, for each channel, the length of the channel part is located between the elements would be no less than 0.7L, where L is the total physical length of the channel.

Other features of the antenna of FIG. 1 are described in the above-mentioned British Patent Applications Nos. 2351850A and 2309592A, the disclosures of which are incorporated in this application by reference.

Figure 2:
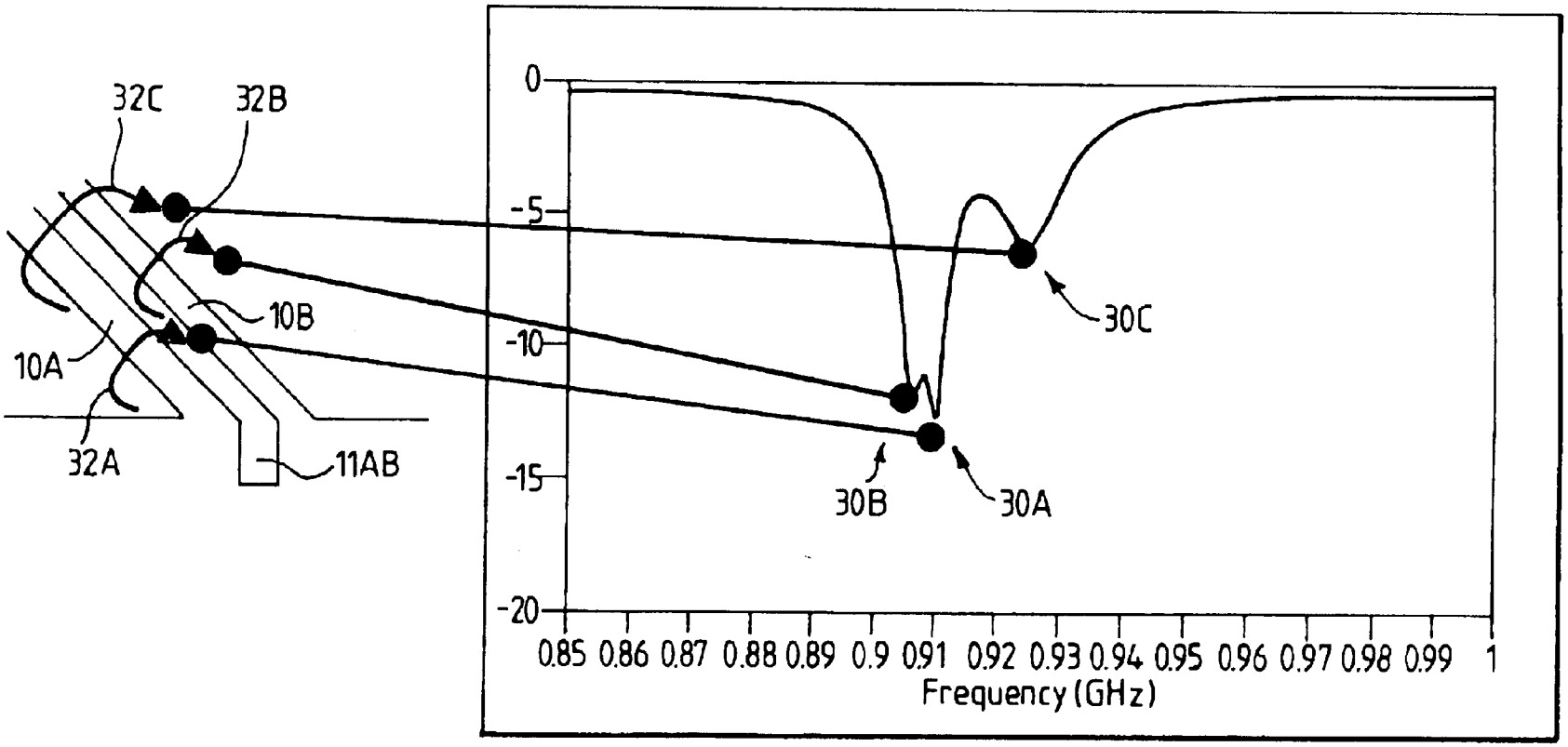
FIG. 2 is a diagram illustrating three fundamental resonances obtained from the antenna of FIG. 1, and an indication of their derivation.

The applicants have discovered that the antenna of FIG. 1 exhibits three fundamental balanced mode resonances. Referring to FIG. 2, which includes a graph plotting insertion loss (S11) with frequency and also shows a portion of one of the groups of antenna elements 10A, 10B where they meet the rim 20U of the sleeve 20 (see FIG. 1). Each individual element 10A, 10B gives rise to a respective resonance 30A, 30B. The electrical lengths of the elements are such that these resonances are close together and are coupled. Each of these resonances has an associated current in the respective radiating element 10A, 10B which, in turn, induces a respective magnetic field 32A, 32B around the element 10A, 10B and passing through the slit 11AB, as shown in FIG. 2. The applicants have discovered that there exists a third mode of resonance, which is also a balanced mode resonance, with an associated current which is common to both elements 10A, 10B and which has an associated induced magnetic field 32C that encircles the group 10AB of elements 10A, 10B without passing through the channel or slit 11AB between the two elements 10A, 10B.

The coupling between the resonances 30A, 30B due to the individual tracks can be adjusted by adjusting the length of the channel 11AB which isolates the two tracks from each other. In general, this involves forming the channel so that it passes a short distance into the sleeve 20. This yields circumstances that permit each helical element 10A, 10B to behave as a half wave resonant line, current fed at the distal end face of the core 12 (FIG. 1) and short circuited at the other end, i.e., the end where it meets the rim 20U of the sleeve 20, such that either (a) resonant currents can exist on any one element or (b) no currents exist due to the absence of drive conditions.

As explained above, the frequencies of the resonances associated with the individual elements 10A, 10B are determined by the respective track widths which, in turn, set the wave velocities of the signals that they carry.

The applicants have found that it is possible to vary the frequency of the third resonance 30C differently from the frequencies of the individual element resonances 30A, 30B.

Figure 3A:
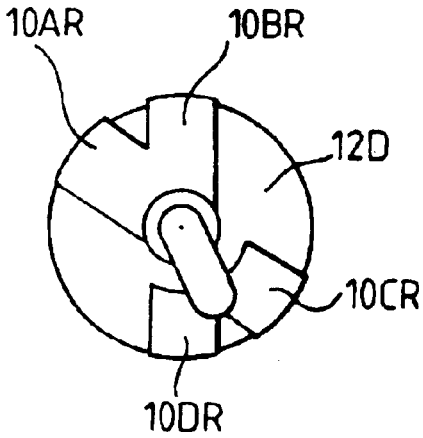
FIGS. 3A, 3B and 3C are respectively a plan view of an antenna in accordance with the invention, a side view of such an antenna, and a "mask" view of the cylindrical surface of the antenna transformed to a plane.
Figure 3B:
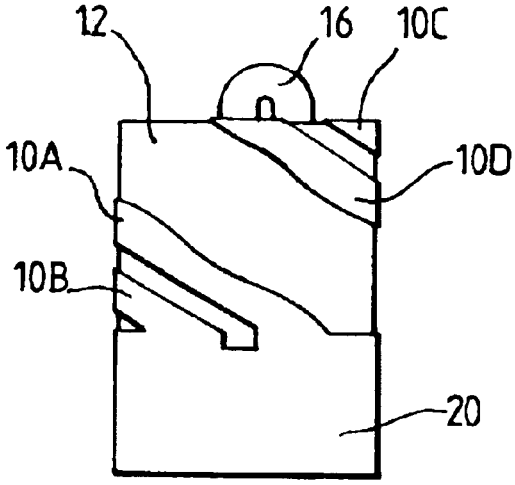
Figure 3C:
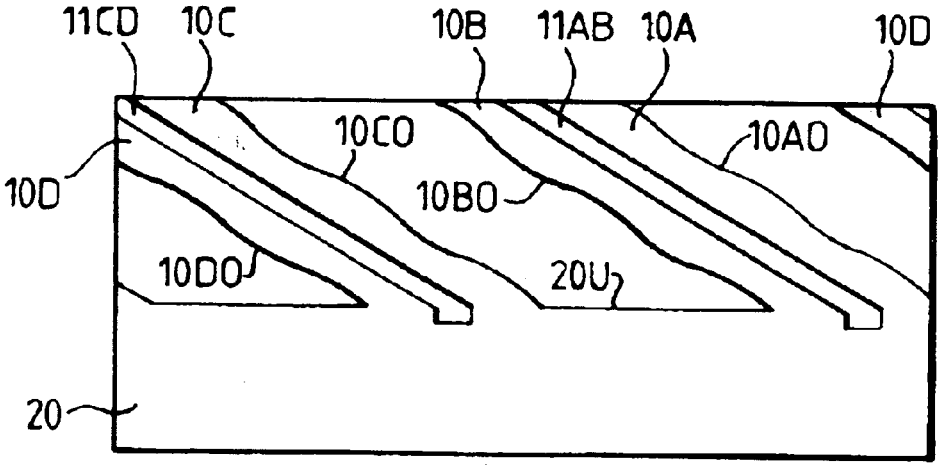

In the preferred embodiment of the present invention, this is done by forming the helical elements 10A, 10B, 10C and 10D such that their outermost edges are meandered with respect to their respective helical paths, as shown in FIGS. 3A to 3C. As will be seen from FIGS. 3C, the outwardly directed edge 10AO, 10BO, 10CO, 10DO of each helical element 10A to 10D deviates from the helical path in a sinusoidal manner along the whole of its length. The inner edges of the elements 10A to 10D are, in this embodiment, strictly helical and parallel to each other on opposite sides of the respective channel 11AB, 11CD. The sinusoidal paths of the outermost edges of the elements of each group are also parallel. This is because at any given point along the elements 10A, 10B or 10C, 10D of a group, the deviations of the respective outermost edges are in the same direction. The deviations also have the same pitch and the same amplitude.

The effect of the meandering of the outermost edges of the elements 10A, 10B, 10C, 10D is to shift the natural frequency of the common-current mode down to a frequency which depends on the amplitude of the meandering. In effect, the common-current resonant mode which produces resonance 30C (FIG. 2) has its highest current density at the outermost edges 10AO to 10DO, and altering the amplitude of the meandering tunes the frequency of the resonance 30C at a faster rate than the frequencies of the individual elements (i.e. the resonances 30A, 30B in FIG. 2). This is because, as will be seen from FIG. 2, when compared with FIG. 3C, the currents associated with the common-current mode, producing resonance 30C, are guided along two meandering edges 10AO, 10BO; 10CO, 10DO, rather than along one meandered edge and one straight edge as in the case of the individual elements 10A to 10D.

Figure 4:
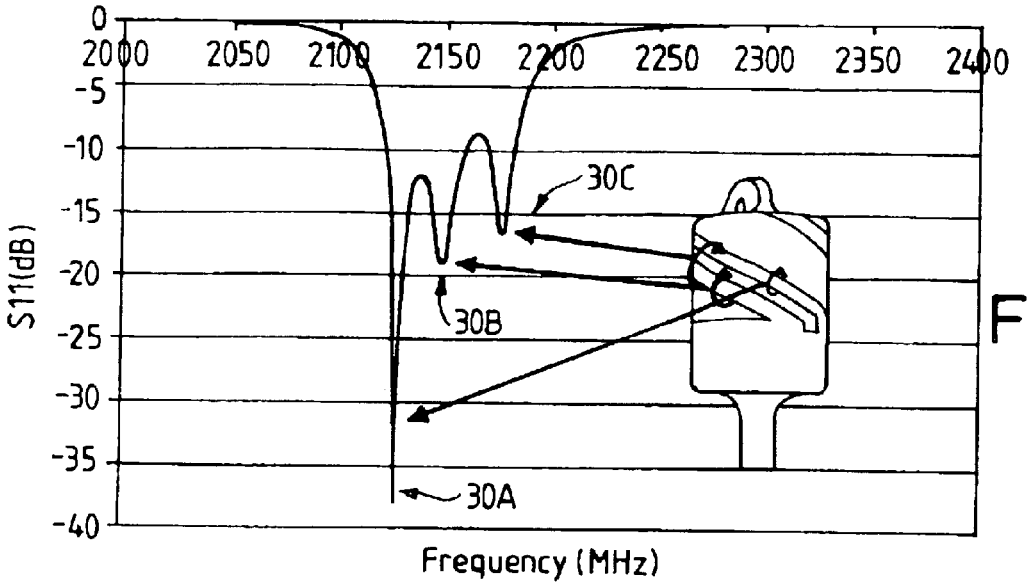
FIG. 4 is a diagram similar to that of FIG. 2, showing resonances obtained with the antenna of FIGS. 3A to 3C, together with an indication of their derivation.

This variation in the length of the outermost edges of the elements 10A to 10D can be used to shift the third resonance 30C closer to the resonances 30A and 30B, as shown in FIG. 4, to produce an advantageous insertion loss characteristic covering a band of frequencies. In the particular example shown in FIG. 6, the antenna has an operating band coincident with the IMT-2000 3-G receive band of 2110 to 2170 MHz, and a fractional bandwidth approaching 3% at −9 dB has been achieved.

Figure 5A:
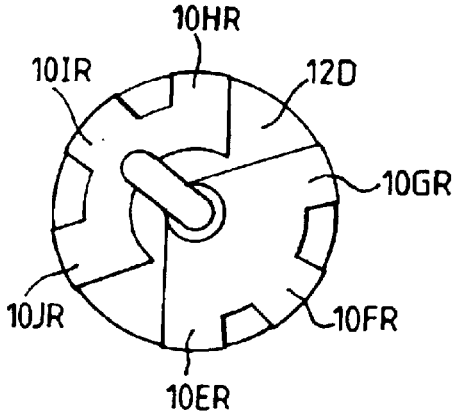
FIGS. 5A to 5C are, respectively, plan, side, and "mask" views of a second antenna in accordance with the invention.
Figure 5B:
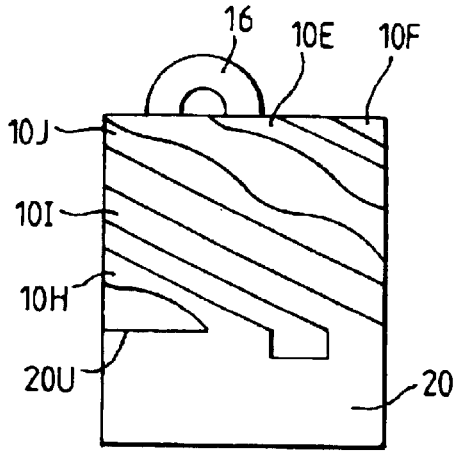
Figure 5C:
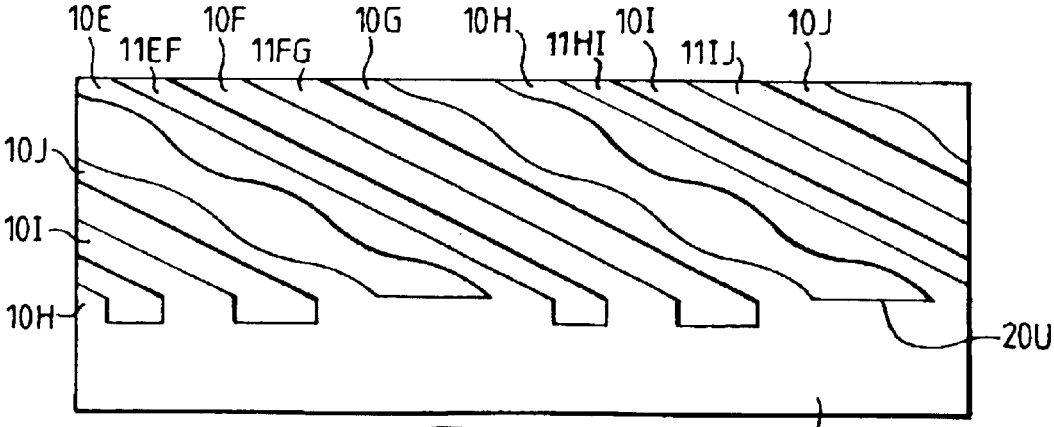

In an alternative embodiment of the invention, each group of antenna elements may comprise three elongate elements 10E, 10F, 10G, 10H, 101 and 10J, as shown in FIGS. 5A to 5C, which are views corresponding to the views of FIGS. 3A to 3C in respective of the first embodiment.

As before, each element has a corresponding radial portion 10ER to 10JR connecting to the feeder structure, and each element is terminated at the rim 20U of the sleeve 20. The elements within each group 10E, 10F, 10G; 10H, 101, 10J are separated from each other by half wave channels 11EF, 11FG; 11HI, 11IJ which, as in the first embodiment, extends from the distal face 12D of the core into the sleeve 20, as shown.

In addition, as in the embodiment of FIGS. 3A to 3C, the elements in each group are of different average widths, each element within each group having an element of a corresponding width in the other group, elements of equal average width being diametrically opposed across the core on opposite sides of the core axis. In this case, the narrowest elements are elements 10ER and 10HR. The next wider elements are those labelled 10GR and 10JR, and the widest elements are the elements in the middle of their respective groups, elements 10FR and 10IR.

Figure 6:
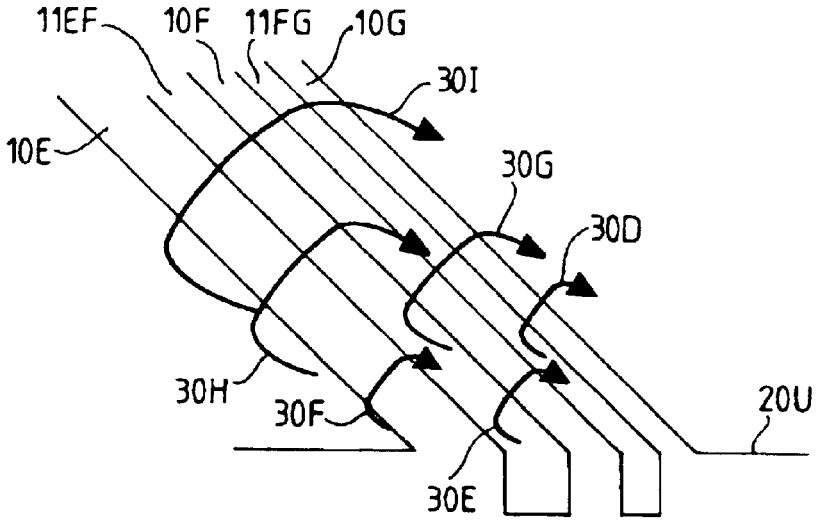
FIG. 6 is another diagram similar to part of FIG. 2 showing the derivation of resonances of the antenna of FIGS. 5A to 5C.
Figure 7:
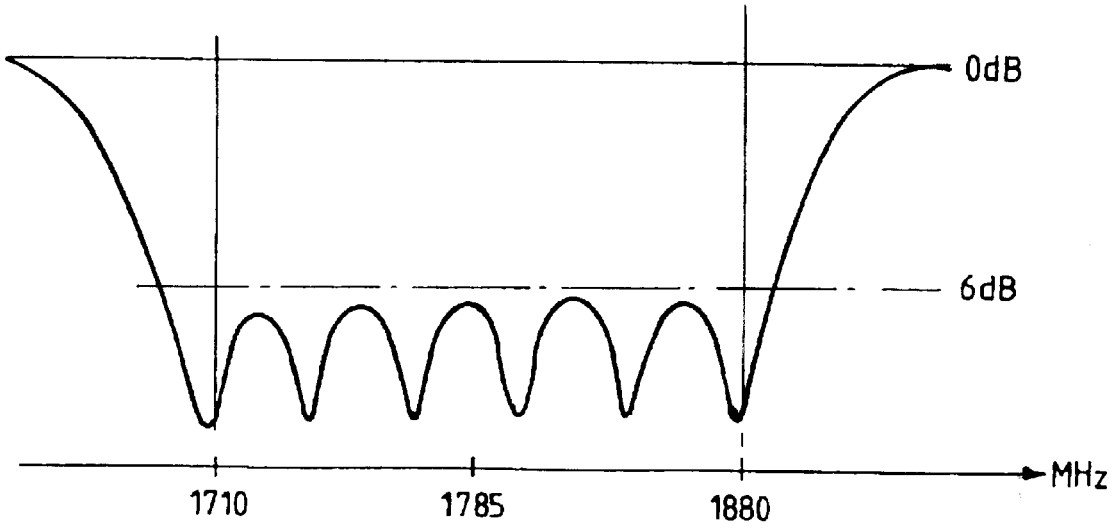
FIG. 7 is a graph indicating the resonances which may be obtained with an antenna of the kind shown in FIGS. 5A to 5C.

Referring to the diagram of FIG. 6, it will be seen that, in addition to the currents in the individual elements of each group, giving rise to correspondingly induced magnetic fields 30D, 30E, and 30F, the three-element structure offers shared current modes associated with currents common to respective pairs of elements (producing magnetic fields 30G and 30H) and currents common to all three elements (producing a magnetic field appearing in FIG. 6 as field 301). It follows that this antenna offers six fundamental balanced mode resonances which, with appropriate adjustment of the widths of the elements 10E to 10J and meandering of element edges, can be brought together as a collection of coupled resonances, as shown in FIG. 7. In this case, the antenna is configured to produce resonances forming an operating band corresponding to the GSM 1800 band extending from 1710 to 1880 MHz.

Referring back to FIG. 5C, it will be seen that in this embodiment, the outer elements of each group have their outermost edges meandered. In practice, the inner edges of the outer elements 10E, 10G; 10H, 10J may also be meandered, but to a lesser amplitude than the meandering of the outer edges. The edges of the inner elements 10F, 101 are helical in this case.

While the bandwidth of an antenna can be increased using the techniques described above, some applications may require still greater bandwidth. For instance, the 3-G receive and transmit bands as specified by the IMT-2000 frequency allocation are neighbouring bands which, depending on the performance required, may not be covered by a single antenna. Since dielectrically-loaded antennas as described above are very small at the frequencies of the 3-G bands, it is possible to mount a plurality of such antennas in a single mobile telephone handset. The antennas described above are balanced mode antennas which, in use, are isolated from the handset ground. It is possible to employ a first antenna covering the transmit band and a second antenna covering the receive band, each having a filtering response (as shown in the graphs included in the drawings of the present application) to reject the other band. This allows the expensive diplexer filter of the conventional approach in this situation (i.e. a broadband antenna and a diplexer) to be dispensed with.

What is claimed is:

1. A dielectrically-loaded loop antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of conductive elongate elements, each group comprising first and second substantially coextensive elongate elements which have different electrical lengths at a frequency within an operating frequency band of the antenna and are coupled together at respective first ends at a location in the region of the feed connection and at respective second ends at a location spaced from the feed connection, the antenna element structure further comprising a linking conductor linking the second ends of the first and second elongate elements of one group with the second ends of the first and second elements of the other group, whereby the first elements of the two groups form part of a first looped conductive path, and the second elements of the two groups form part of a second looped conductive path, such that the said paths have different respective resonant frequencies within the said band and each extend from the feed connection to the linking conductor, and then back to the feed connection, wherein at least one of the said elongate antenna elements comprises a conductive strip having non-parallel edges.

2. An antenna according to claim 1, wherein that edge of the strip which is furthest from the other elongate element or elements in its group is longer than the edge which is nearer the other elongate clement or elements of the group.

3. An antenna according to claim 1, wherein the first and second elongate elements of each group have an edge which is an outermost edge of the group and both outermost edges are longer than the inner edges of the said elements of the group.

4. An antenna according to claim 3, wherein the said outermost edges of each group are substantially parallel to each other.

5. An antenna according to claim 2, wherein the longer edges are each meandered over the major part of their length.

6. An antenna according to claim 1, wherein each group of elongate antenna elements has two mutually adjacent elements.

7. An antenna according to claim 6, wherein the elongate elements of each pair have different electrical lengths and define between them a parallel-sided channel, each element having a meandered outer edge.

8. An antenna according to claim 1, wherein each group of elongate antenna elements has three said elongate elements arranged side-by-side.

9. An antenna according to claim 8, wherein the outwardly directed edges of the outer elements of each group are meandered and the inner element is parallel-sided.

10. An antenna according to claim 8, wherein at least one of the outer elements of each group has a meandered outer edge and a meandered inner edge, the amplitude of the meandering of the outer edge being greater than that of the inner edge.

11. An antenna according to claim 1, wherein the said elongate antenna elements each extend from the feed connection to the linking conductor, and each has an electrical length in the region of a half wavelength at a frequency within the operating frequency band of the antenna.

12. An antenna according to claim 1, wherein the core is cylindrical and the feed connection comprises a feeder termination on an end face of the core, and wherein the major part of each said elongate antenna element comprises a helical conductor which executes a half turn around the core centred on the core axis, and wherein the linking conductor comprises an annular conductor around the core centred on the axis.

13. An antenna according to claim 12, including an axial feeder structure extending through the core from the feeder connection on a first end face of the core to a second end face of the core, and wherein the linking conductor comprises a conductive sleeve connecting the said second ends of the elongate elements to the feeder structure at a position spaced from the said feeder connection.

14. An antenna according to claim 1, having a fractional bandwidth of at least 3% at an insertion loss of −6 dB.

15. A dielectrically-loaded antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of conductive elongate elements, each group comprising first and second substantially coextensive elongate elements which have different electrical lengths at a frequency within an operating frequency band of the antenna and are coupled together at respective first ends at a location in the region of the feed connection and at respective second ends at a location spaced from the feed connection, the antenna element structure further comprising a linking conductor linking the second ends of the first and second elongate elements of one group with the second ends of the first and second elements of the other group, whereby the first elements of the two groups form part of a first looped conductive path, and the second elements of the two groups form part of a second looped conductive path, such that the said paths have different respective resonant frequencies within the said band and each extend from the feed connection to the linking conductor, and then back to the feed connection, wherein at least one of the said elongate antenna elements comprises a conductive strip on the outer surface of the core, the strip having opposing edges of different lengths.

16. An antenna according to claim 15, wherein that edge of the strip which is furthest from the other elongate element or elements in its group is longer than the edge which is nearer the other elongate element or elements of the group.

17. An antenna according to claim 15, wherein the first and second elongate elements of each group have an edge which is an outermost edge of the group and both outermost edges are longer than the inner edges of the said elements of the group.

18. An antenna according to claim 17, wherein the said outermost edges of each group are substantially parallel to each other.

19. An antenna according to claim 16, wherein the longer edges are each meandered over the major part of their length.

20. An antenna according to claim 15, wherein each group of elongate antenna elements has two mutually adjacent elements.

21. A dielectrically-loaded loop antenna for operation at frequencies in excess of 200 MHz, comprising an electrically insulative core of a solid dielectric material having a relative dielectric constant greater than 5, a feed connection, and an antenna element structure disposed on or adjacent the outer surface of the core, wherein the core has end surfaces and side surfaces and an axis of symmetry passing through the end surfaces, and wherein the antenna element structure comprises a pair of laterally opposed groups of elongate antenna elements, each group forming part of each of a plurality of looped conductive paths extending from a first terminal to a second terminal of the feed connection, and each group comprising first and second substantially coextensive elongate radiating elements which have different electrical lengths at a frequency within an operating band of the antenna and which run side-by-side on or adjacent the side surfaces of the core, wherein at least one of the said elongate elements on or adjacent the side surfaces comprises a conductive strip having non-parallel edges.

22. An antenna according to claim 21, wherein the feed connection is located on one of the end surfaces of the core and the said elongate elements of the group are connected to the feed connection by a plurality of connecting elements on or adjacent the said end surface.

23. An antenna according to claim 21, wherein the strip has non-parallel edges over at least the major part of its length on the respective side surface or surfaces of the core.

* * * * *